US006409548B1

(12) United States Patent
Guttierez

(10) Patent No.: US 6,409,548 B1
(45) Date of Patent: Jun. 25, 2002

(54) MICROELECTRONIC CONNECTOR WITH OPEN-CAVITY INSERT

(75) Inventor: Aurelio Guttierez, Bonita, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 09/705,454

(22) Filed: Nov. 2, 2000

(51) Int. Cl.[7] ..... H01R 23/02
(52) U.S. Cl. ..... 439/676; 439/620
(58) Field of Search ..... 439/676, 620, 439/490, 76, 607, 608, 609, 626; 29/878; 361/728

(56) References Cited

U.S. PATENT DOCUMENTS

| | | | | |
|---|---|---|---|---|
| 4,695,115 | A | 9/1987 | Talend | 439/76 |
| 4,699,595 | A | 10/1987 | Nakazawa et al. | 439/676 |
| 4,726,638 | A | 2/1988 | Farrar et al. | 439/620 |
| 4,772,224 | A | 9/1988 | Talend | 439/620 |
| 4,995,834 | A | 2/1991 | Hasegawa | 439/620 |
| 5,015,204 | A | 5/1991 | Sakamoto et al. | 439/620 |
| 5,015,981 | A | 5/1991 | Lint et al. | 336/65 |
| 5,069,641 | A | 12/1991 | Sakamoto et al. | 439/620 |
| 5,139,442 | A | 8/1992 | Sakamoto et al. | 439/620 |
| 5,178,563 | A | 1/1993 | Reed | 439/676 |
| 5,282,759 | A | 2/1994 | Sakamoto et al. | 439/620 |
| 5,397,250 | A | 3/1995 | Briones | 439/620 |
| 5,399,107 | A | 3/1995 | Gentry et al. | 439/676 |
| 5,403,207 | A | 4/1995 | Briones | 439/620 |
| 5,456,619 | A | 10/1995 | Belopolsky et al. | 439/620 |
| 5,475,921 | A | 12/1995 | Johnston | 29/878 |
| 5,587,884 | A | 12/1996 | Raman | 361/728 |
| 5,647,767 | A | 7/1997 | Scheer et al. | 439/620 |
| 5,687,233 | A | 11/1997 | Loudermilk et al. | 379/442 |
| 5,697,817 | A | 12/1997 | Bouchan et al. | 439/676 |
| 5,736,910 | A | 4/1998 | Townsend et al. | 333/181 |
| 5,766,043 | A | 6/1998 | Talend | 439/676 |
| 5,872,492 | A | 2/1999 | Boutros | 333/182 |
| 5,876,239 | A | 3/1999 | Morin et al. | 439/490 |

FOREIGN PATENT DOCUMENTS

| | | |
|---|---|---|
| EP | 0 654 865 B1 | 5/1995 |
| WO | WO 94/05059 | 3/1994 |

*Primary Examiner*—P. Austin Bradley
*Assistant Examiner*—Alexander Gilman
(74) *Attorney, Agent, or Firm*—Knobbe Martens Olson & Bear LLP

(57) ABSTRACT

A multi-piece microelectronic connector is disclosed which permits rapid assembly of the connector components during manufacture. The connector is comprised of an insert and a connector body. The insert has a cavity configured to receive at least one electrical component. The insert also has leads for electrically connecting the electrical component with a modular plug. The connector body has a front, a back and a dividing wall separating the front and the back. The front of the connector body has a cavity for receiving a modular plug therein. The back has a cavity for receiving the insert therein. The dividing wall has a set of openings providing communication between the cavity in the front and the cavity in the back. The set of leads of the insert are configured to protrude through the set of openings in the dividing wall and into the cavity in the front of the connector body.

10 Claims, 8 Drawing Sheets

MICROELECTRONIC CONNECTOR WITH OPEN-CAVITY INSERT

BACKGROUND OF THE INVENTION

1. Field of the Invention

The invention relates generally to miniature electrical connectors used in printed circuit board and other microelectronic applications, and more particularly to a microelectronic connector with improved modularity and a method of fabricating the same.

2. Description of Related Technology

Existing microelectronic electrical connectors (such as those of the RJ 45 or RJ 11 type) frequently incorporate magnetics or other electrical components to provide a variety of functions, such as signal voltage transformation or noise suppression. In one common connector design, the magnetics or component package is fabricated as a separate device that is then subsequently inserted within or mated to another component of the connector. See, for example, U.S. Pat. No. 5,647,767 "Electrical Connector Jack Assembly for Signal Transmission" ("'767 patent"), and U.S. Pat. No. 5,587,884, "Electrical Connector Jack with Encapsulated Signal Conditioning Components" ("'884 patent"). A related design illustrated in U.S. Pat. No. 5,178,563, "Contact Assembly and Method for Making Same" employs the multi-component arrangement of the '767 and '884 patents, yet with no installed electrical component. Common to each of the aforementioned designs is the use of a separate lead insulator or "carrier" that insulates and segregates the electrical leads connecting the modular plug contacts with the electrical component (or output leads of the connector). This general lead carrier arrangement is illustrated in FIG. 1*a*.

In addition to the functions listed above, as shown in FIG. 1*b*, a lead carrier 110 also acts as a mechanical fulcrum for the leads 120 when installed. Specifically, the distal ends 115 of the leads engage contacts of a modular plug 130 when the plug 130 is inserted into a connector body 100, thereby tending to bend the leads 120 upward and away from the plug 130. The modular plug 130 has a latch 131 which securely engages the plug 130 with the connector body 100. The plug 130 is shown in FIG. 1*b* with the latch 131 on the underside of the plug, also referred to as a "latch-down" configuration. The carrier 110 tends to maintain the leads 120 in engagement with their respective contacts on the modular plug 130, thereby increasing the reliability of the connector. This is especially true during relative movement of the plug 130 within the connector body 100 or after many insertion/removal duty cycles.

While providing the above-identified functionality, the use of a lead carrier 110 has several drawbacks as well. Specifically, the additional labor and materials associated with molding and inspecting the lead carrier 110 add significant cost to the final product. Furthermore, the connector body ("sleeve") 100 requires additional costly tooling to accommodate the carrier 110. After carrier insertion, the distal ends of the leads 120 must also be bent into their final position. This adds another process step and precludes the subsequent removal of the leads 120 and carrier 110 from the connector body 100. Additionally, the carrier 110 provides no bias or resistance to separating the component package 140 (and carrier 110) from the connector body 100, thereby necessitating the use of adhesives or other means for maintaining a solid connection of these components.

Once an existing microelectronic connector has been installed in, for example, a printed circuit board, replacement of the component package 140 requires removal and replacement of the entire connector. Further, one set of leads 150 is typically soldered to the circuit board to provide mechanical stability and a secure electrical connection. Thus, removal of the connector and the attached component package 140 is made difficult.

Accordingly, it would be most desirable to provide an improved microelectronic connector design that would yield a simpler and more reliable connector, and further facilitate more economical fabrication. Such a connector design would avoid the use of a separate lead carrier and mating adhesives, thereby simplifying the manufacturing process and reducing device cost. The improved connector would also utilize a simplified and compact mounting system to further reduce manufacturing costs. Additionally, the improved connector would provide for simple replacement of components.

SUMMARY OF THE INVENTION

The invention satisfies the aforementioned needs by providing an improved microelectronic connector and method of fabricating the same.

According to one aspect of the invention, a microelectronic connector assembly comprises an insert having a first cavity which is configured to receive at least one electrical component; a set of leads extending from the insert, the set of leads being configured to provide an electrical connection between the electrical component and a modular plug; and a connector body having a front, a back, and a dividing wall separating the front from the back, the front having a second cavity adapted to receive a modular plug therein, the back having a third cavity for receiving the insert, and the dividing wall having a set of openings providing communication between the second cavity and the third cavity, wherein the set of leads are configured to protrude through the set of openings into the second cavity.

According to another aspect of the invention, a method of manufacturing a microelectronic connector comprises providing a connector body with a front having a first cavity adapted to receive modular plugs, a back having a second cavity adapted to receive an insert, and a dividing wall separating the front from the back, the dividing wall having openings for allowing leads to pass between the first cavity and the second cavity; and inserting an insert into the second cavity, the insert having a set of leads and a third cavity, the set of leads passing through the openings into the second cavity, the third cavity being adapted to receive at least one electrical component.

According to yet another aspect of the invention, a microelectronic connector assembly comprises an insert, the insert comprising means for receiving at least one electrical component and means for electrically connecting the electrical component with a modular plug; and a connector body, the connector body comprising means for receiving a modular plug in a first location; means for receiving the insert in a second location different from the first location; and means for separating the means for receiving a modular plug and the means for receiving the insert, the separating means including means for passing the electrically connecting means between the means for receiving a modular plug and the means for receiving the insert.

According to another aspect of the invention, a microelectronic connector assembly comprises an insert having a first cavity configured to receive at least one electrical component; and a connector body having a front, a back, and a dividing wall separating the front from the back, the front having a second cavity adapted to receive a modular plug therein, the back having a third cavity for receiving the insert, and the dividing wall having a set of openings providing communication between the second cavity and the third cavity.

DETAILED DESCRIPTION OF THE INVENTION

Reference is now made to the drawings wherein like numerals refer to like parts throughout.

Figure 1B:
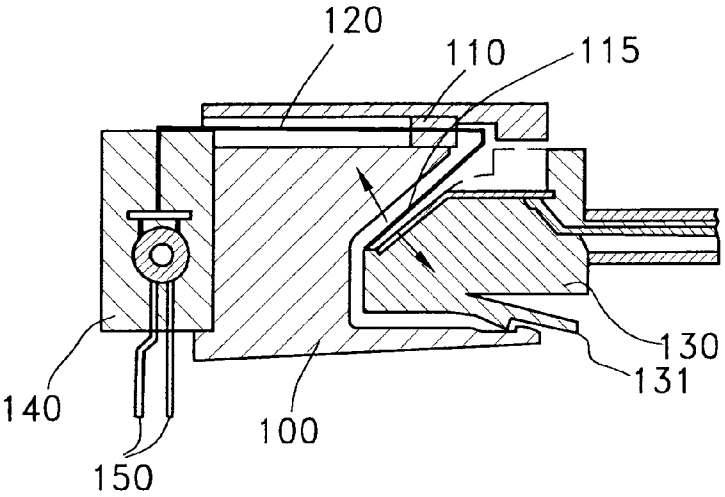
FIG. 1B (PRIOR ART)
FIG. 1*b* is a side elevation view of the prior art connector of FIG. 1*a* with modular plug inserted, showing the relative relationship of the leads, plug contacts, and lead carrier.
Figure 1A:
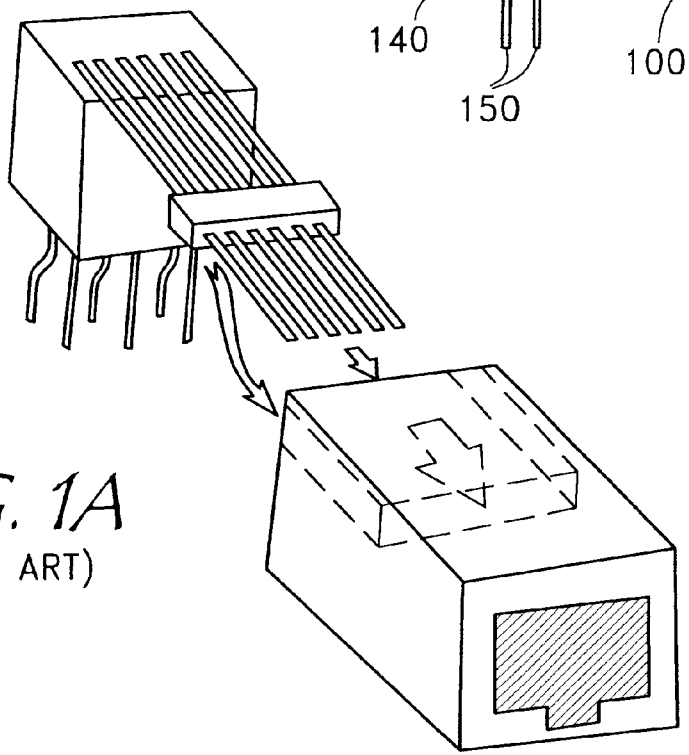
FIG. 1A (PRIOR ART)
FIG. 1*a* is an exploded perspective view of a prior art electrical component connector utilizing a lead carrier assembly.
Figure 2A:
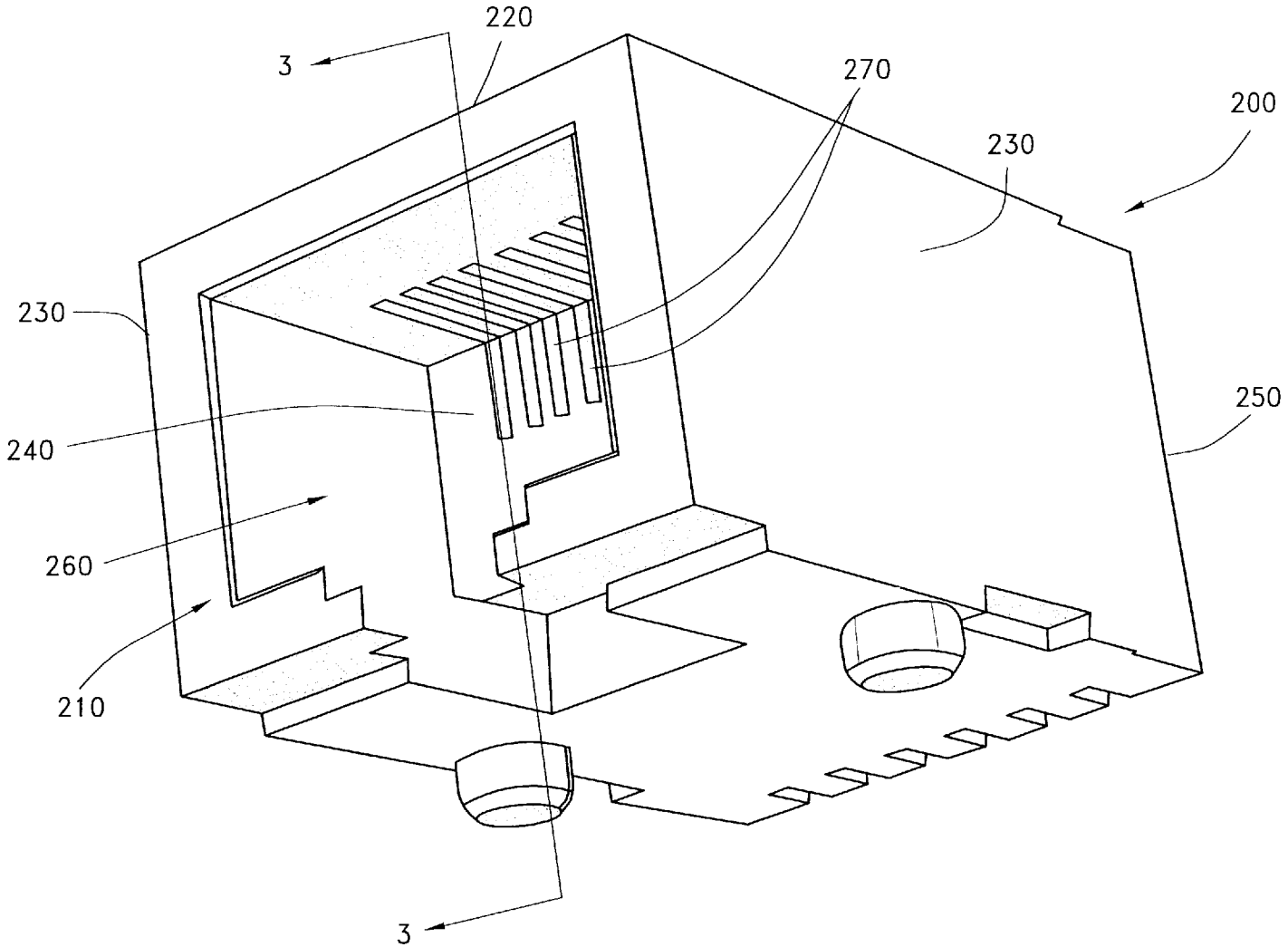
FIG. 2A is a perspective view of the front portion of one embodiment of a connector body according to the invention.
Figure 2B:
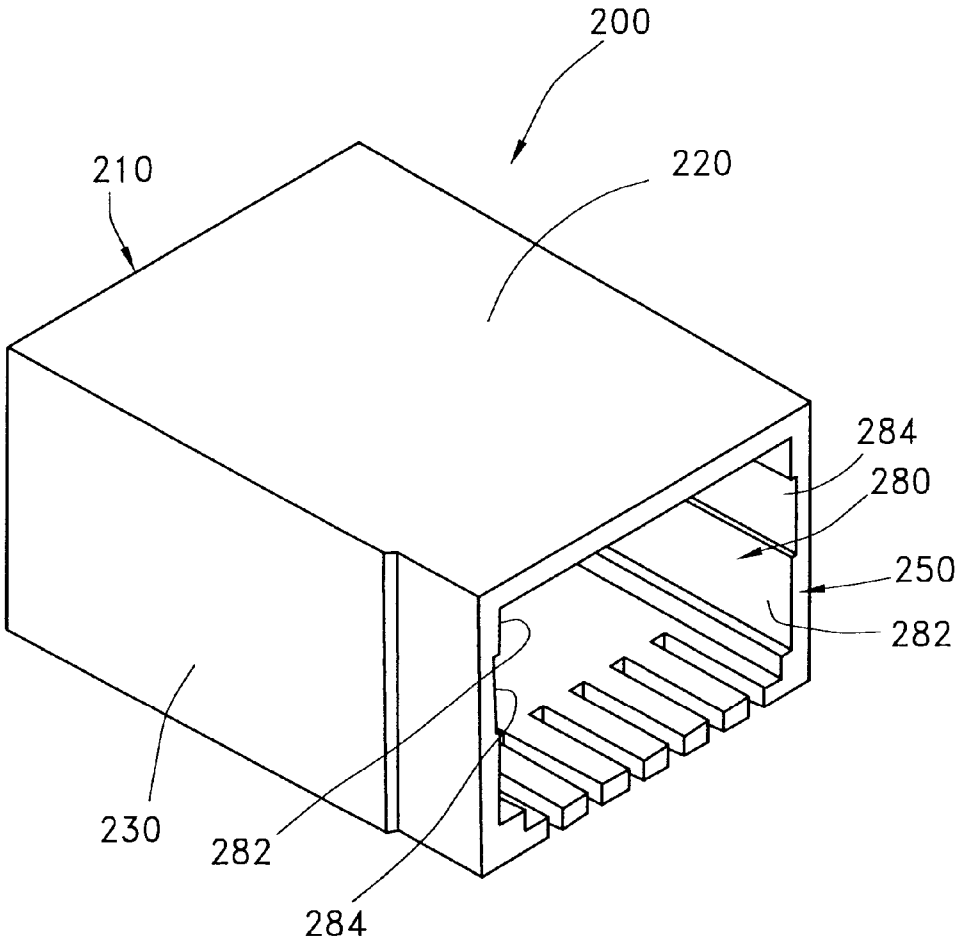
FIG. 2B is a perspective view of the back portion of the connector body shown in FIG. 2A.
Figure 3:
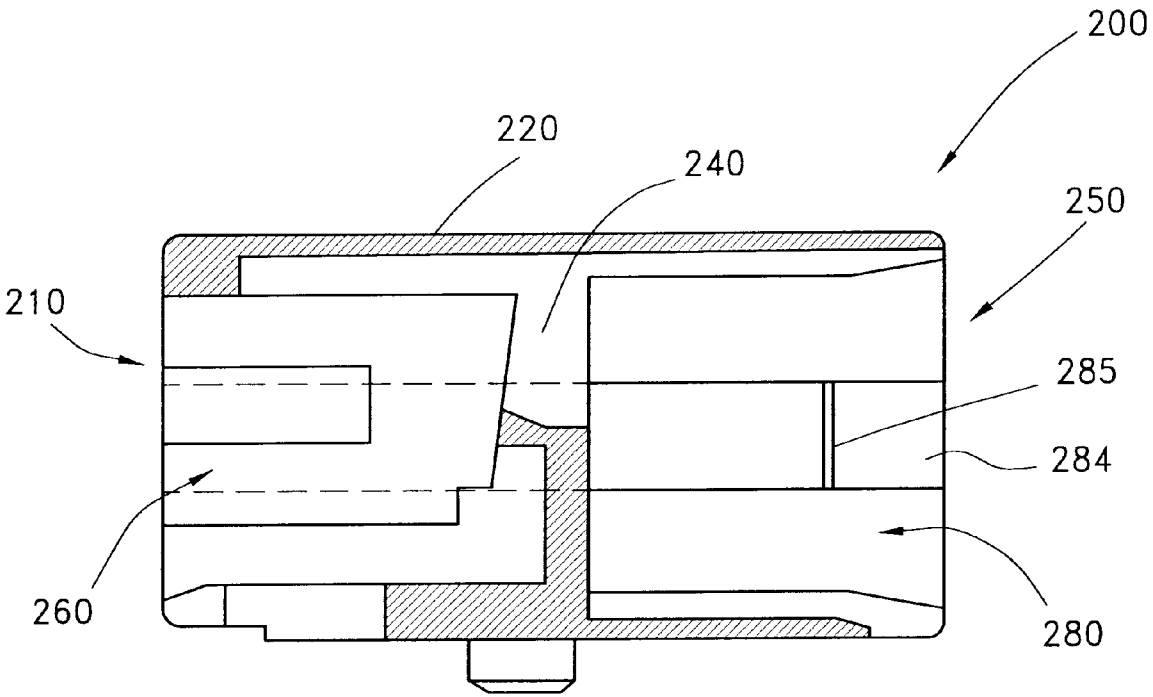
FIG. 3 is a cross-sectional side view of the connector body of FIGS. 2A and 2B taken along line 3—3 of FIG. 2A.

FIGS. 2A, 2B and 3 illustrate a first embodiment of a connector body 200 of the invention. Referring initially to FIG. 2A, the connector includes a body 200 which may be formed of a unitary construction. The connector body 200 is ideally formed from a nonconductive material, such as nylon, using an injection molding process of the type well known in the art, although other materials and processes may be substituted. The connector body 200 has a top wall 220 and side walls 230 which extend downward from opposite ends of the top wall 220 in planes that are perpendicular to that of the top wall 220. A separating wall 240 separates the back 250 of the connector body 200 from its front 210. The separating wall 240 extends downward from the top wall 220 in a plane that is perpendicular to that of the side walls 230. The front 210 has a cavity 260 for accommodating a modular plug (not shown) therein. The cavity 260 terminates at the separating wall 240. The back 250 also has a cavity 280 (not shown in FIG. 2A) terminating at the separating wall 240.

The separating wall 240 is provided with a set of vertical openings 270. The number of openings 270 in the set corresponds to the number of leads to be provided for contacting a modular plug. The openings 270 in the separating wall 240 begin at the line of intersection of the separating wall 240 with the top wall 220 and extend downwardly from the intersection along the separating wall 240. The openings 270 allow communication between a cavity 280 in the back 250 of the connector body 200 and the cavity 260 in the front 210 of the connector body 200.

As seen in FIG. 2B, the cavity 280 in the back 250 has side surfaces 282 with latching slots 284 defined along the interior surface thereof. The latching slots 284 extend from the back end of the side surfaces 282 of the cavity 280 inward to a latching point 285 (shown in FIG. 3). The latching slots 284 run in a direction that is parallel to the line formed by the intersection of the top wall 220 and a side wall 230, while the latching point 285 protrudes from the side wall 230 and runs perpendicular to the latching slots 284.

Figure 4:
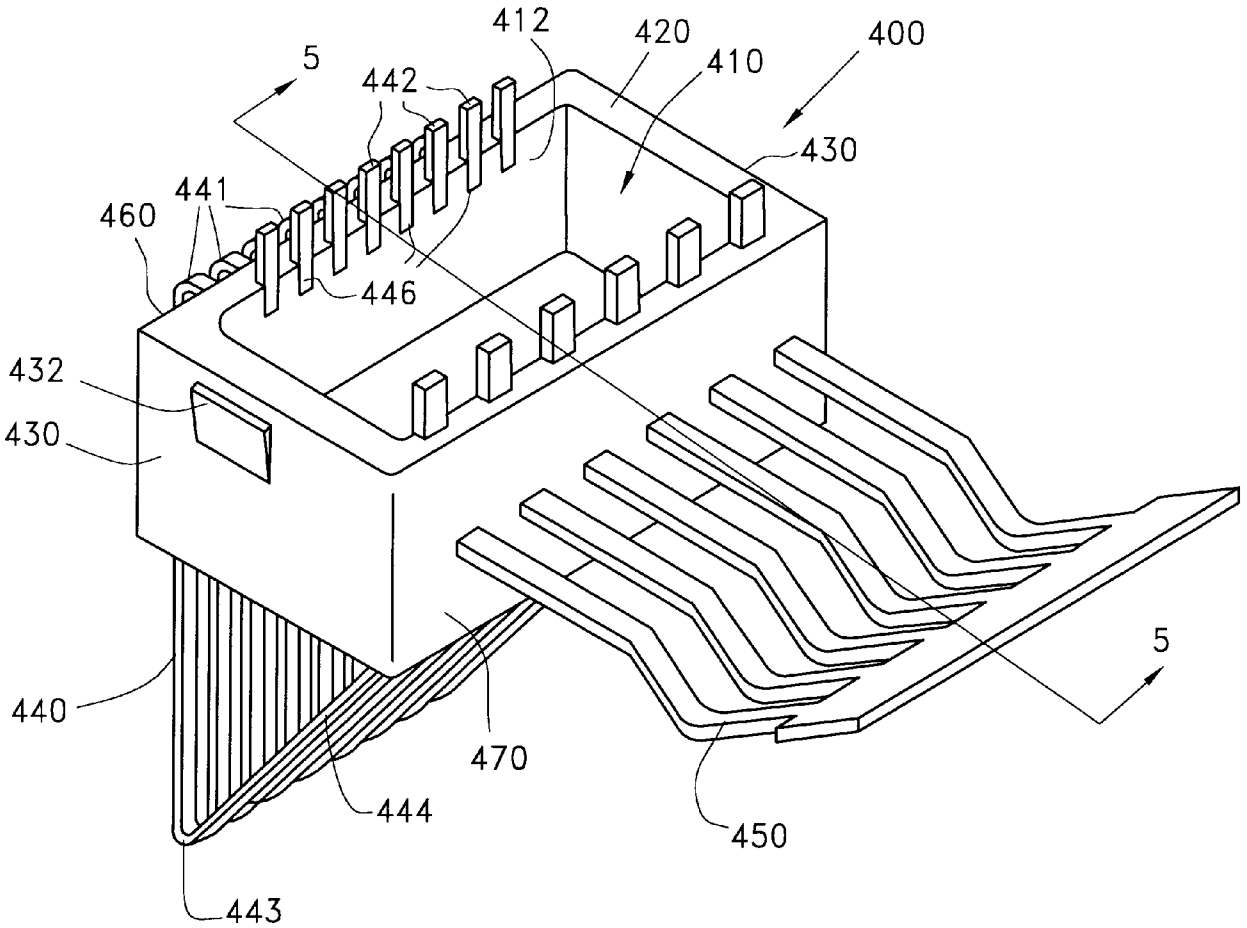
FIG. 4 is a perspective view of an insert according to the present invention.
Figure 5:
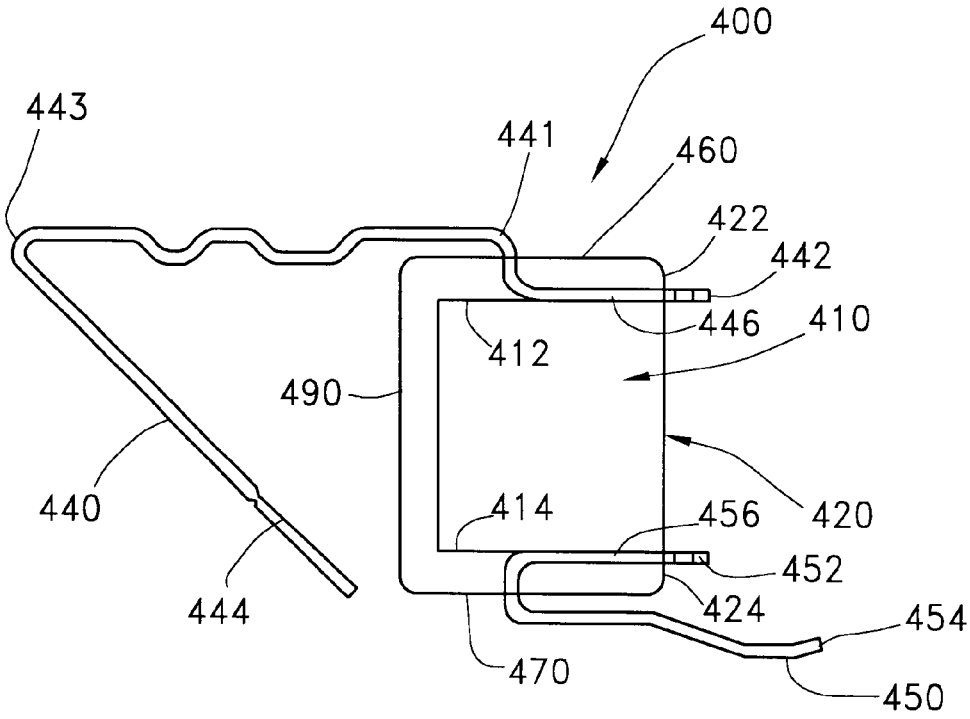
FIG. 5 is a cross-sectional side view of the insert of FIG. 4 taken along line 5—5 of FIG. 4.

The cavity 280 in the back 250 of the connector body 200 is adapted to receive an insert. FIGS. 4 and 5 illustrate one embodiment of an insert 400. The insert 400 includes an open cavity 410 for accommodating a magnetics or component package (not shown) to provide any of a variety of functions, such as signal voltage transformation or noise suppression. One or more electrical components may be integral with the component package.

It should also be noted that with respect to the invention, the term "electrical component" includes, without limitation, (i) discrete components such as resistors, capacitors, and inductors; (2) magneto-electric devices (such as choke coils and transformers); and (3) semiconductive devices.

In the embodiment illustrated in FIGS. 4 and 5, the insert 400 is configured substantially as a rectangular box. Referring to FIG. 4, a back face 420 of the insert 400 defines the outer rim of the cavity 410. A front face 490 (see FIG. 5) is configured as a rectangular wall and opposes the back face 420. The front face 490 is in a plane that is substantially parallel to that of the back face 420. The insert 400 also has a top face 460 and an opposing bottom face 470, each being perpendicular to the side faces 430 and the back face 420 and extending away from the back face 420. The insert 400 also comprises a first set 440 and a second set 450 of electrical leads extending from the top face 460 and the bottom face 470, respectively.

Two side faces 430 are connected to the front face 490 and the back face 420 and are in planes that are substantially perpendicular to those of the front face 490 and the back face 420. Each side face 430 is provided with a protrusion 432 located near the intersection of the side face 430 and the back face 420. The protrusion 432 extends from the side face 430 near the intersection, tapering to merge with the side face 430 away from the intersection, in a configuration so as to slide into the latching slots 284 (shown in FIG. 2B) and to engage the latching point 285 (shown in FIG. 3) of the connector body 200. The insert 400 can thus be secured within, for example, the cavity 280 (shown in FIGS. 2A, 2B and 3) in the back 250 of the connector body 200 by interlocking the protrusions 432 of the insert 400 with the corresponding latching point 285 of the connector body 200.

The first set of leads 440, with a first end 442 and a second end 444, is adapted to contact a modular plug within, for example, the cavity 260 in the front 210 of the connector body shown in FIGS. 2A and 3. A portion 446 of the first set of leads 440 near the first end 442 is completely embedded within the top face 460 of the insert 400 by, for example, molding the insert body 400 around the leads. The first end 442 of the first set of leads 440 protrudes from the back face 420 along a first edge 422 of the opening to the cavity 410. Alternatively and preferably, as illustrated in FIGS. 4 and 5, the portion 446 may be partially exposed to an upper wall 412 of the cavity 410. The first set of leads 440 extends upward from the top face 460 of the insert 400. At a location along the body of the leads 440, they are bent at a roughly 90-degree angle, forming a first bend 441, such that the leads 440 are substantially flush with the top face 460 of the insert 400 and extend in a horizontal direction toward the plane of the front face 490 of the insert 400. At another location along their body between the second end 444 and the first bend 441, the leads 440 are bent again at an angle of roughly 150 degrees to form a second bend 443.

The second set of leads 450, with a first end 452 and a second end 454, is adapted for providing an electrical connection with, for example, a printed circuit board. In accomplishing this, a portion 456 of the second set of leads 450 near the first end 452 is completely embedded within the bottom face 470 of the insert 400 by, for example, molding the insert body 400 around the leads. The first end 452 of the second set of leads 450 extends from the back face 420 along a second edge 424 of the opening to the cavity 410. Alternatively and preferably, as illustrated in FIG. 5, the portion 456 may be partially exposed to a lower wall 414 of the cavity 410. The second set of leads 450 extends downward from the bottom face 470 of the insert 400. The leads 450 may then be bent in any direction necessary for a connection with, for example, a printed circuit board.

Figure 6:
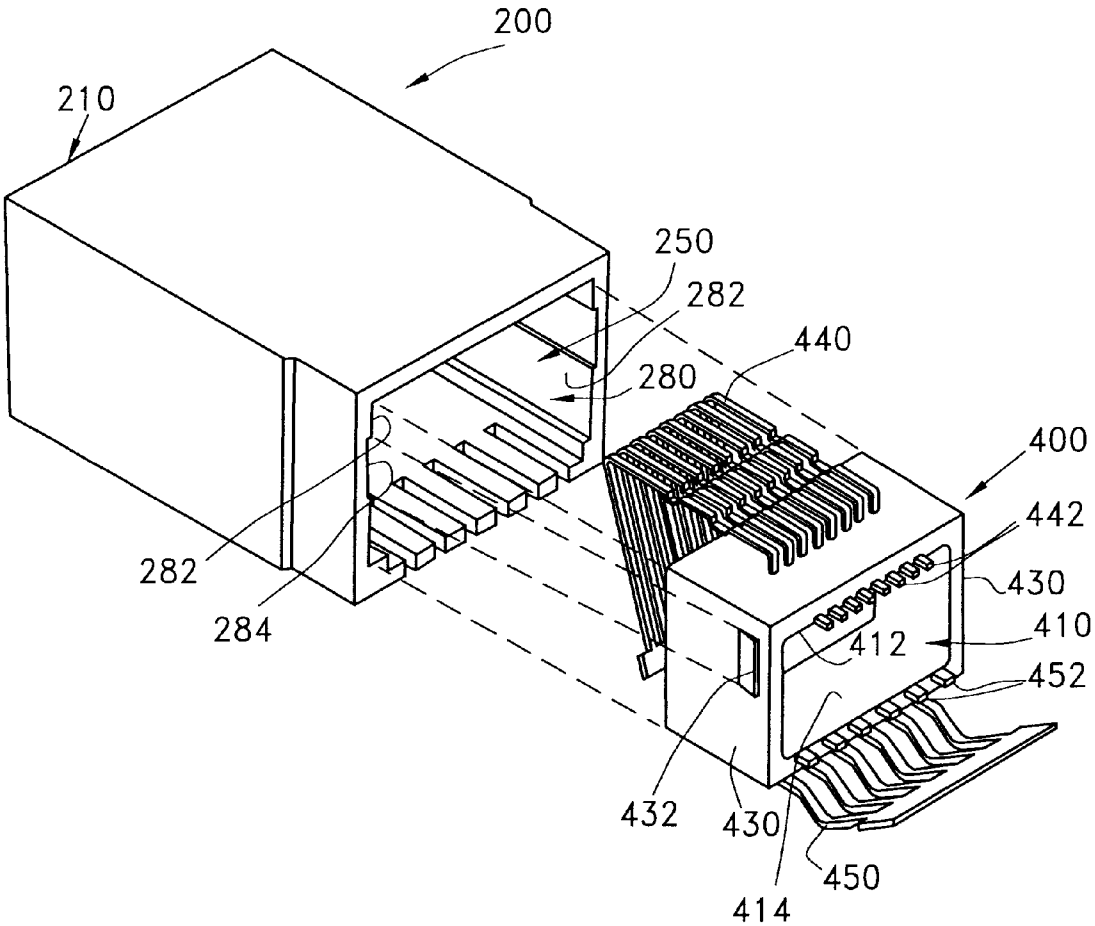
FIG. 6 is a perspective view of relative arrangement of the insert shown in FIGS. 4 and 5 and the connector body of FIGS. 2A, 2B and 3.

FIG. 6 illustrates the insertion of the insert 400 into the connector body 200. The insert 400 slides into the cavity 280 in the back 250 of the connector body 200. The shape of the cavity 280 is configured to accommodate the shape of the insert 400. The protrusions 432 on the side faces 430 of the insert 400 slide into the latching slots 284 on the side surfaces 282 of the cavity 280 in the back 250 of the connector body 200. The first set of leads 440 of the insert 400 slide through the set of openings 270 (shown in FIG. 2A) into the cavity 260 in the front 210 of the connector body 200. Thus, the leads 440 are placed in a position to contact a modular plug inserted into the cavity 260 in the front 210. When the insert 400 is completely inserted into the cavity 280, the protrusions 432 of the insert 400 engage the latching points 285 (shown in FIG. 3) by interlocking the protrusions 432 with the latching points 285. The insert 400 is thereby securely attached to the connector body 200.

The cavity 410 of the insert 400 can accommodate electrical components (not shown) therein. The electrical components may be inserted within the cavity 410 either before or after insertion of the insert 400 into the connector body 200. The electrical components contact the first set of leads 440 and the second set of leads 450 of the insert 400. The point of this contact may either comprise the first ends 442, 452 of the leads 440, 450 or the portions 446, 456 (shown in FIGS. 4 and 5) of the leads 440, 450 partially exposed within the upper wall 412 and the lower wall 414 of the cavity 410. The electrical components may be secured within the cavity 410 with the use of a nonconductive adhesive or a mechanical latch. An adhesive may provide a secure, permanent connection of the electrical component to the first and second sets of leads 440, 450. A mechanical latch system may allow the electrical components to be readily removed and replaced.

Figure 7:
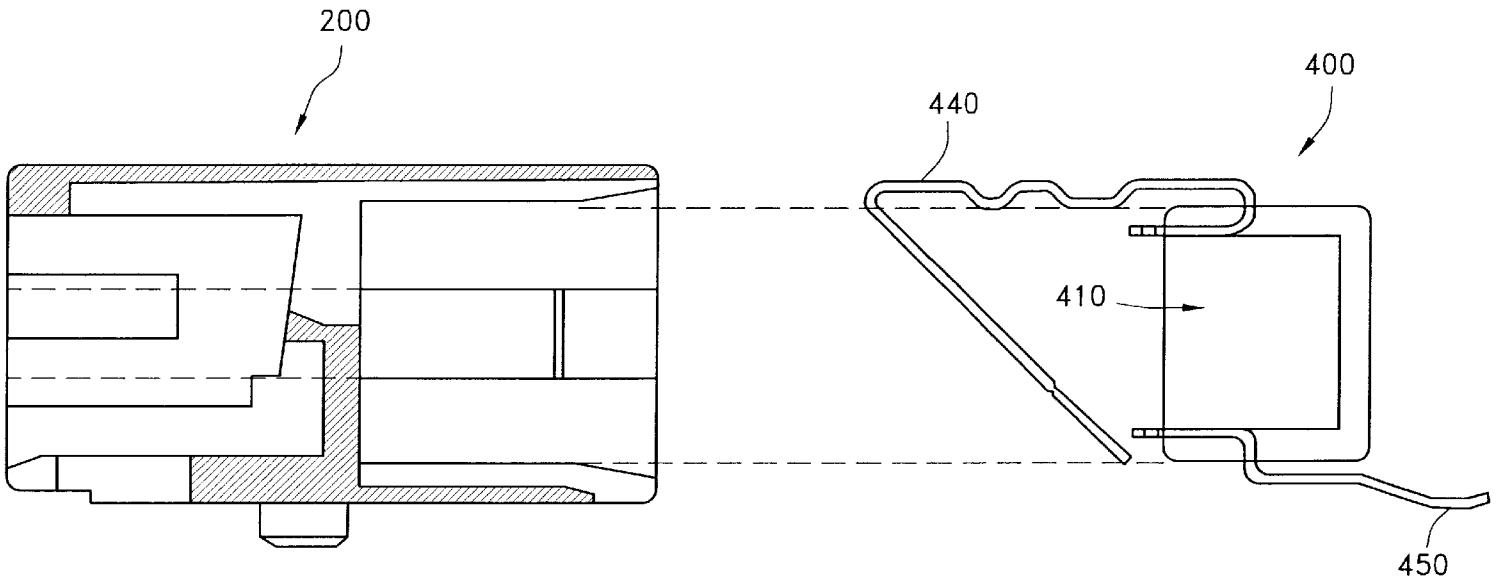
FIG. 7 is a cross-sectional view of a microelectronic connector according to another embodiment of the invention.

The embodiment of the insert 400 shown in FIGS. 4–6 provides a cavity 410 opening to the rear of the assembly when the insert 400 is inserted into the connector body 200. FIG. 7 illustrates another embodiment of the insert 400 according to the invention in which the cavity 410 of the insert 400 opens forward. In this arrangement, the electrical components (not shown) must be inserted prior to the insertion of the insert 400 into the connector body 200 since access to the cavity 410 is not available after insertion.

Once the insert 400 is inserted into the connector body 200 (as shown in FIG. 6 or FIG. 7), the insert is easily removable. As discussed above, the insert 400 is securely attached in the connector body 200 when the protrusions 432 are interlocked with the latching points 285. This interlocking engagement is secure but not permanent. To remove the insert, the protrusions 432 can be depressed inwardly by any flat, small tool, thereby disengaging the protrusions 432 from the latching points 285. The insert 400 can then be removed from the connector body 200 as inward pressure on the protrusions 432 is maintained until the protrusions 432 clear the latching points 285 and the insert 400 is fully removed from the cavity 280 of the connector body 200.

Thus, the invention provides a reliable microelectronic connector which is provided through simple fabrication and assembly. The connector according to the invention allows simple replacement of electrical components and provides increased modularity of the elements of the connector.

While the above detailed description has shown, described, and pointed out novel features of the invention as applied to various embodiments, it will be understood that various omissions, substitutions, and changes in the form and details of the device illustrated may be made by those skilled in the art without departing from the spirit of the invention.

What is claimed is:

1. A microelectronic connector assembly, comprising:

an insert having a first face and a second face, wherein the first face and second face define a first cavity, said first cavity being configured to receive at least one electrical component;

a plurality of first leads comprising first ends embedded within the first face such that a portion of the first ends of the first leads is exposed to the first cavity so as to make an electrical connection with an electrical component received in the first cavity, the plurality of first leads further comprising second ends extending from said insert, said second ends of the plurality of first leads being configured to provide an electrical connection with a modular plug;

a plurality of second leads comprising first ends embedded within the second face such that a portion of the first ends of the second leads is exposed to the first cavity so as to make an electrical connection with an electrical component received in the first cavity, the plurality of second leads further comprising second ends extending from said insert and configured to provide an electrical connection with a printed circuit board; and a connector body having a front, a back, and a dividing wall separating said front from said back, said front having a second cavity adapted to receive a modular plug therein, said back having a third cavity for receiving the insert, and said dividing wall having a plurality of openings providing communication between said second cavity and said third cavity, wherein the plurality of first leads are configured to protrude through the plurality of openings into the second cavity.

2. The microelectronic connector assembly according to claim 1, wherein the first cavity comprises an opening directed away from the connector body.

3. The microelectronic connector assembly according to claim 1, wherein the first cavity comprises an opening directed into the connector body.

4. The microelectronic connector assembly according to claim 1, further comprising an electrical component package having at least one electrical component therein, the electrical component package configured to be received in the first cavity.

5. The microelectronic connector assembly according to claim 1, wherein the third cavity comprises slots configured to removably maintain the insert therein.

6. The microelectronic connector assembly according to claim 5, wherein the insert comprises notches which engage the slots.

7. A method of manufacturing a microelectronic connector, comprising:

providing a connector body with a front having a first cavity adapted to receive at least one modular plug, a back having a second cavity adapted to receive an insert, and a dividing wall separating said front from said back, said dividing wall having openings for allowing leads to pass between said first cavity and said second cavity; and inserting an insert into the second cavity, said insert having a plurality of first leads, a plurality of second leads, and a third cavity, wherein first ends of the plurality of first leads are embedded within a first face of the insert such that a portion of the first ends of the first leads is exposed to the first cavity such that the first leads are configured to make an electrical connection with an electrical component received in the first cavity, wherein second ends of the plurality of first leads extend from said insert through the openings into the second cavity and are configured to provide an electrical connection with a modular plug, and wherein first ends of the plurality of second leads are embedded within a second face of the insert such that a portion of the first ends of the second leads is exposed to the first cavity so as to make an electrical connection with an electrical component received in the first cavity, wherein the plurality of second leads further comprise second ends extending from said insert and are configured to provide an electrical connection with a printed circuit board, and wherein said third cavity is adapted to receive at least one electrical component.

8. The method according to claim 7, wherein the insert is provided with notches, and wherein the second cavity is provided with slots, said method further comprising:

engaging the notches of the insert with the slots of the second cavity so as to secure the insert within said second cavity.

9. The method according to claim 7, wherein the third cavity of the insert comprises an opening directed away from the connector body.

10. The method according to claim 7, wherein the third cavity of the insert comprises an opening directed into the connector body.

* * * * *